United States Patent [19]

Fountain et al.

[11] 4,028,235

[45] June 7, 1977

[54] FROTH FLOTATION WITH SEWAGE TREATMENT PLANT WATER EFFLUENT

[75] Inventors: Gerald F. Fountain; Jaime Veloz; Edward A. Bilson; John A. Cronin, all of Inspiration, Ariz.

[73] Assignee: Inspiration Consolidated Copper Company, Morristown, N.J.

[22] Filed: June 4, 1976

[21] Appl. No.: 692,926

[52] U.S. Cl. ..... 210/44; 209/166; 75/2

[51] Int. Cl.[2] ..... B03D 1/02

[58] Field of Search ..... 210/44, 59; 209/166, 209/167; 75/2

[56] References Cited

UNITED STATES PATENTS

| | | | |
|---|---|---|---|
| 2,362,432 | 11/1944 | Cahn | 209/166 |
| 2,761,563 | 9/1956 | Waterman et al. | 210/44 |
| 3,252,662 | 5/1966 | Lyons et al. | 210/44 |
| 3,710,939 | 1/1973 | Hostynek et al. | 209/166 |

*Primary Examiner*—Thomas G. Wyse
*Assistant Examiner*—Benoit Castel
*Attorney, Agent, or Firm*—Pennie & Edmonds

[57] ABSTRACT

The improvement in the process of concentrating a sulfide mineral by froth flotation from an aqueous pulp of an ore containing such mineral, comprising using as at least part of the aqueous phase of the pulp sewage treatment plant water effluent conditioned prior to use with at least about 3 parts per million of a polyglycerol.

5 Claims, No Drawings

FROTH FLOTATION WITH SEWAGE TREATMENT PLANT WATER EFFLUENT

BACKGROUND OF THE INVENTION

Large volumes of water are necessary and are used for froth flotation in mining operations. In many areas water is scarce and becoming more so, and this is particularly true in the Southwestern United States; especially in Arizona where there are large copper mining facilities.

In an attempt to supplement the limited water supply, efforts have been made to use the water effluent from sewage treatment plants in ore flotation operations. These efforts have not been successful since it has been found that, while on some occasions the effluent is suitable, on the vast majority of occasions such effluent is extremely detrimental to the process of ore flotation in which the majority of water is used in ore processing.

The precise reasons for this detrimental effect are not known, but it is speculated that detergents, surfactants, fatty acids, and/or other organic hydrocarbons present in the sewage effluent affect the natural hydrophilic qualities of the gangue material present with the ore so that the gangue is activated and floats in the ore concentrate; the gangue is not depressed as in the usual flotation operations.

Treatments of the sewage effluent have been tried to reduce this detrimental effect, but they have not been successful or desirable for commercial operations mainly because of cost or because the particular treatment is not capable of coping with the wide variation in materials and in concentrations of materials present in sewage effluent from day to day.

Thus, for example, hydrated lime has been added to the effluent to precipitate undesirable materials, but it has been found that large amounts of lime are required to minimize the adverse effects of the sewage effluent on flotation and, also, additional equipment in the form of settlers to remove the lime precipitate from the effluent before use. The result is a cost of more than 25 cents per 1,000 gallons of effluent treated.

Another procedure tried has been physical treatment of the sewage effluent prior to use. The effluent has been processed by a thickener type operation followed by aeration and additional settling. The clarified effluent was then used for flotation, but still found to have a detrimental effect. It has been found that a minimum of four days of aeration were needed to completely reduce the adverse effects of the effluent. The cost in providing sufficient aeration reservoirs and settling equipment is such that this treatment procedure is not commercially desirable. To use sewage effluent at 2,000 gpm, four separate aeration reservoirs with a capacity of 3 million gallons each would be required.

SUMMARY OF THE INVENTION

The present invention provides a conditioned sewage treatment plant water effluent which can comprise up to 100% of the aqueous phase of an ore flotation pulp without having any adverse effects on the flotation.

Briefly stated, the present invention comprises the improvement in the process of concentrating a sulfide mineral by froth flotation from an aqueous pulp of an ore containing such mineral, comprising using as at least part of the aqueous phase of the pulp sewage treatment plant water effluent conditioned prior to use with at least about 3 parts per million of a polyglycerol.

In its preferred embodiment, the present invention is directed to the use of such effluent in the froth flotation of copper sulfide ores.

DETAILED DESCRIPTION

The instant invention will be described in connection with the froth flotation of copper sulfide ores.

The ore is prepared for flotation utilizing any of the procedures and apparatus conventional for this purpose. The instant invention is not directed to such preparation and does not require any ore preparation steps of conditions prior to froth flotation other than those conventionally used.

As used herein, the term "sewage treatment plant water effluent" is meant to include all water effluents that result from the treatment of sewage in municipal or other sewage treatment facilities. All that is required is the conditioning of the effluent with a polyglycerol as hereinafter described. No other chemical treatment or physical treatment such as clarification, settling, and/or aeration or any treatment of the effluents are required or necessary prior to use in froth flotation. The conditioned effluent alone can be added to the ore to form the aqueous pulp to be floated or the effluent can be used in any lesser amount in combination with the usual water supply, i.e., water from a river, lake, well, or the like.

The essential and critical step in the process is the conditioning of the effluent with a polyglycerol prior to formation of the aqueous pulp. The polyglycerol must be added to the effluent in an amount sufficient to eliminate the adverse effects of the effluent on flotation. Normally, this is from about 3 to about 10 parts per million (ppm). While larger amounts of a polyglycerol may be used, it has been found that no appreciable beneficial effect has been formed. Importantly, however, adding larger amounts of a polyglycerol does not adversely affect the flotation.

The time required to condition the effluent is very short. A contact time of the polyglycerol and effluent of, at most, about 10 minutes is all that is required. In practical terms, this permits the polyglycerol to be added to the effluent at a plant pump station and, as the effluent is pumped and stored in the usual intermediate reservoirs, the necessary conditioning is accomplished.

It must be stated that the reason or reasons why a polyglycerol is able to eliminate the adverse effects of the effluent on flotation is not known.

After the conditioning, the conditioned effluent can be handled as any water supply to form the aqueous pulp of the ore to be floated. The conditioned effluent alone, or admixed with the usual water supply in any proportion as noted above, is added to the ore in the usual amounts to form an aqueous pulp to be floated. The aqueous pulp can then be subjected to froth flotation, such as rougher flotation, without any detrimental effect on flotation.

The conditioning of the pulp with a polyglycerol is the only treatment required of the effluent although, as discussed later herein, it may be desired to deodorize the effluent. If desired, the usual collectors in their usual amounts can be added to enhance the flotation recovery of desired ore.

The polyglycerols used are viscous liquids comprising mixtures of ethers of glycerol with itself, ranging from diglycerol to triacontaglycerol, which are soluble in water, alcohol, and other polar solvents. The molecular weights and boiling points of a particular polyglycerol mixtue will vary dependent upon the proportions of particular ethers present therein. For the purposes of the present invention, it is most desirable to use polyglycerols containing a major proportion of a mixture of glycerol, diglycerol, triglycerol, tetraglycerol, and pentaglycerol (about 55% to 80% by weight of the total weight of the polyglycerol) with the remainder being the higher ethers. The preferred polyglycerols are highly viscous and, for ease of use, they can be diluted with water; as by adding about 20% to 30% water. Commercially available polyglycerols are known to also contain minor amounts, 3% to 6% by weight, of sodium salts, such as NaC1 and $Na_2CO_3$. It has been found that this minor amount of salt does not have any significant effect on the performance of the polyglycerols and, thus, they can be used as commercially available. Examples are HL-70 and 80 by Mining & Industrial Chemicals.

As to the desired polyglycerols, they should not contain more than about 15% by weight of glycerol and, preferably, the range of glycerol and its ethers based on the total weight of the undiluted polyglycerol is as follows:

| | % by Weight |
|---|---|
| Glycerol | 8 – 14 |
| Diglycerol | 24 – 30 |
| Triglycerol | 10 – 14 |
| Tetraglycerol | 7 – 10 |
| Pentaglycerol | 6 – 9 |
| Heavier polyglycerols | balance |

The invention will be further described in connection with the following examples which are set forth for purposes of illustration only and in which proportions are by weight unless expressly stated to the contrary.

EXAMPLE 1

A series of rougher flotations were run on a copper sulfide pulp. The aqueous phase of the pulp in one run was tap water alone and on the other runs various mixtures of sewage treatment plant water effluent with the tap water up to 100% effluent. The effluent in this series of flotations had not been conditioned in accordance with the present invention, but instead had been clarified by having the solids therein removed by thickening followed by aeration and additional settling.

The results of the flotation ae set forth in Table I:

TABLE I

| Run | % Sewage Water In Aqueous Pulp | Wt. % in Rougher Concentration | Grade of Rougher Concentration, %Cu |
|---|---|---|---|
| 1 | 0 | 2.53 | 12.69 |
| 2 | 5 | 2.13 | 15.30 |
| 3 | 10 | 2.44 | 14.82 |
| 4 | 15 | 3.31 | 9.42 |
| 5 | 20 | 2.89 | 11.47 |
| 6 | 25 | 3.21 | 9.95 |

TABLE I-continued

| Run | % Sewage Water In Aqueous Pulp | Wt. % in Rougher Concentration | Grade of Rougher Concentration, %Cu |
|---|---|---|---|
| 7 | 30 | 4.90 | 6.35 |
| 8 | 35 | 4.87 | 6.29 |
| 9 | 40 | 4.74 | 7.94 |
| 10 | 45 | 5.91 | 5.58 |
| 11 | 50 | 7.78 | 4.07 |
| 12 | 75 | 14.19 | 2.25 |
| 13 | 100 | 16.15 | 2.18 |

The data in Table I show that the sewage effluent had a detrimental effect on flotation by increasing the amount of insolubles floated into the rougher concentrate which decreases the grade of the rougher concentrate. The increased weight of rougher concentrate, in turn, decreases the flotation time in the cleaner flotation because of overloading which will generally decrease the grade of the cleaner concentrate and increase the amount of the cleaner tails which is added back to the rougher flotation circuit.

EXAMPLE 2

A series of rougher flotations were run on a copper sulfide pulp as in Example 1, except that the sewage treatment plant water effluent used had been conditioned with various concentrations of a polyglycerine* having the following analysis:

| | Weight % |
|---|---|
| Glycerol | 8 – 14 |
| Diglycerol | 24 – 30 |
| Triglycerol | 10 – 14 |
| Tetraglycerol | 7 – 10 |
| Pentaglycerol | 6 – 9 |
| Heavier polyglycerols | Balance |
| Total salt as $NaCl + Na_2CO_3$ | 3% – 6% |

*HL-80

No other treatment was given to the effluent.

The results of the flotations are set forth in Table II.

TABLE II

| Run | Polyglycerine | | Weight % in Rougher Concentration | Grade of Rougher Concentration % Cu |
|---|---|---|---|---|
| | Tap Water (Standard) | 0 ppm | 2.22 | 22.56 |
| 2 | Sewage (Standard) | 0 ppm | 8.07 | 7.04 |
| 3 | Sewage (Conditioned) | 1 ppm | 4.19 | 13.02 |
| 4 | Sewage (Conditioned) | 3 ppm | 2.95 | 18.52 |
| 5 | Sewage (Conditioned) | 5 ppm | 2.68 | 20.94 |
| 6 | Sewage (Conditioned) | 7 ppm | 2.80 | 19.02 |
| 7 | Sewage (Conditioned) | 10 ppm | 2.70 | 20.38 |

These data show that sewage water effluent conditioned with polyglycerol results in recoveries of copper equal to or greater than the standard test with tap water and clearly show the undesirability, again, of untreated sewage water effluent.

It is recognized that the use of the effluent in flotation could cause an odor problem, but this problem, due to odor-causing bacteria, can be controlled, if desired, by chlorinating the effluent, as by chlorination to 0.5 ppm chlorine.

In addition, the usual flotation reagents can be used since the polyglycerol does not interfere therewith.

While the instant invention hs been described in connection with the froth flotation of copper sulfide ores, it is equally applicable to the flotation of other sulfide ores such as those of nickel, zinc, and the like.

While the invention has been described in connection with preferred embodiments, it is not intended to limit the invention to the particular forms set forth, but, on the contrary, it is intended to cover such alternatives, modifications, and equivalents as may be included within the spirit and scope of the invention as defined by the appended claims.

What is claimed is:

1. In the process of concentrating a sulfide mineral by froth flotation from an aqueous pulp of an ore containing such mineral, the improvement comprising using as at least part of the aqueous phase of the pulp sewage treatment plant water effluent conditioned prior to use with at least about 3 parts per million of a polyglycerol comprising, for each 100 parts by weight thereof, from about 55 parts to 80 parts by weight of a mixture of glycerol, diglycerol, triglycerol, tetraglycerol, and pentaglycerol, with the glycerol being present in an amount no greater than about 15 parts by weight.

2. The process of claim 1 wherein the sewage treatment plant water effluent comprises 100% of the aqueous phase of the pulp and the polyglycerol is used in an amount of from about 3 to 10 parts per million.

3. The process of claim 1 wherein the sulfide mineral is a copper sulfide, the sewage treatment plant water effluent comprises up to 100% of the aqueous phase of the pulp, and from about 3 to 10 parts per million of the polyglycerol is used to condition said effluent.

4. The process of claim 3 wherein the polyglycerol comprises by weight for each 100 parts by weight thereof, from about 8 to 14 parts glycerol, about 24 to 30 parts diglycerol, about 10 to 14 parts triglycerol, about 7 to 12 parts tetraglycerol, and about 6 to 9 parts pentaglycerol.

5. The process of claim 1 wherein the polyglycerol comprises by weight for each 100 parts by weight thereof, from about 8 to 14 parts glycerol, about 24 to 30 parts diglycerol, about 10 to 14 parts triglycerol, about 7 to 12 parts tetraglycerol, and about 6 to 9 parts pentaglycerol.

* * * * *